US006986509B2

(12) United States Patent
Koh et al.

(10) Patent No.: US 6,986,509 B2
(45) Date of Patent: Jan. 17, 2006

(54) MEDIA STACK TRAY STATUS MECHANISM

(75) Inventors: Seng San Koh, Singapore (SG); Wui Jein Richard Koh, Singapore (SG); Wei Chun Lim, Singapore (SG)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/773,910

(22) Filed: Feb. 5, 2004

(65) Prior Publication Data

US 2005/0173859 A1 Aug. 11, 2005

(51) Int. Cl.
*B65H 7/08* (2006.01)

(52) U.S. Cl. ..... 271/110; 271/265.01; 271/258.01

(58) Field of Classification Search ..... 271/110, 271/152, 145, 154, 265.01, 117, 265.02, 130, 271/258.01, 25, 31, 38; 270/153
See application file for complete search history.

(56) References Cited

U.S. PATENT DOCUMENTS

| | | | | |
|---|---|---|---|---|
| 4,888,617 | A * | 12/1989 | Okuzawa | 355/400 |
| 5,033,731 | A * | 7/1991 | Looney | 271/176 |
| 5,236,348 | A | 8/1993 | Fetherolf | |
| 5,248,137 | A * | 9/1993 | Rabjohns | 271/155 |
| 5,700,003 | A | 12/1997 | Sung | |
| 5,743,522 | A * | 4/1998 | Rubscha et al. | 271/265.02 |
| 6,206,362 | B1 | 3/2001 | Tan | |
| 6,651,977 | B2 * | 11/2003 | Tanaka | 271/154 |

* cited by examiner

*Primary Examiner*—Kathy Matecki
*Assistant Examiner*—Rakesh Kumar

(57) ABSTRACT

A mechanism for sensing the status of a media stack tray which dispenses media to a printing device, the media stack tray being associated with a dispensing device which dispenses media from the media stack tray. The mechanism includes a probe having at least two positions such that the probe is located in a first position when the media stack tray has an empty status and is located in a second position when the media stack tray has a loaded status. The probe is mounted relative to the media stack tray so that when the media stack tray has a loaded status the media is normally located between the probe and the dispensing device. The mechanism also includes a detector for detecting the position of the probe.

6 Claims, 3 Drawing Sheets

MEDIA STACK TRAY STATUS MECHANISM

FIELD OF INVENTION

The present invention relates to a mechanism for sensing the status of a media stack tray which dispenses media to a printing device.

BACKGROUND OF THE INVENTION

Modern office printing devices, such as printers, photocopiers and facsimile machines, and the like, typically incorporate a media stack tray which is used to store and dispense media (such as paper) from a media stack to a printing head of the device. The dispensing of the media is usually performed using a dispensing device, such as a pick arm or a roller mechanism of some kind, which selects and dispenses media from the media stack tray.

The media stack tray is usually installed within the printing device in such a way that the media stack is not readily visible to a user. Accordingly, the status of the media stack tray, in terms of whether it is empty or loaded with media, is not able to be determined by visual inspection without first removing the media stack tray from the equipment.

To overcome the problem described above, it is common for media stack trays to include a mechanism which provides a visual indication of the status of the media stack tray.

A mechanism for sensing the status of a media stack tray which dispenses media may be of the type disclosed in U.S. Pat. No. 5,700,003. Here, the mechanism includes an actuator, which itself includes a paper contacting unit and an elastic unit. The elastic unit supplies a force to the actuator so that the paper contacting unit contacts the topmost paper sheet of a stack of paper in the media stack tray and applies a downward force onto the same so that the actuator moves downwardly after the topmost sheet is dispensed.

The actuator is connected to a variable resistor so that as the actuator moves downwardly the resistance of the resistor effectively varies according to the height of the paper stack within the media stack tray. The resistance of the resistor is used to determine the status of the media stack tray.

Unfortunately, in mechanisms of the type disclosed in U.S. Pat. No. 5,700,003, the paper contacting unit contacts each sheet which is dispensed from the media stack tray. Such contact may interfere with, or indeed damage (for example, by scratching or marking), the paper which is being dispensed from the top of the paper stack. Where the contact is of a type which exerts a force onto the sheet which is being dispensed, the interference may cause the sheet to be skewed during a dispensing cycle.

U.S. Pat. No. 6,206,362 describes another media stack status indicator. That indicator also includes a paper contacting unit (in the form of a probe member) which rests on the top of a media stack in a media stack tray (such as a tray). Thus, this arrangement shares similar problems to those described in relation to the mechanism disclosed in U.S. Pat. No. 5,700,003.

Another type of mechanism for sensing the status of a media stack tray is disclosed in U.S. Pat. No. 5,236,348. Here, a pivotally mounted indicator is positioned within a housing of the media stack tray. The indicator includes a portion which contacts with a surface of a biased sheet stack platform which is itself movable according to the weight of the media stack on the stack platform. Unfortunately, arrangements of this type have difficulty differentiating between there being no sheets and a few sheets on the stack platform, particularly for media having a light weight.

SUMMARY OF THE INVENTION

In brief, the invention provides a mechanism for sensing the status of a media stack tray which dispenses media to a printing device, the media stack tray being associated with a dispensing device which dispenses media from the media stack tray. The mechanism includes a probe having at least two positions such that the probe is located in a first position when the media stack tray has an empty status and is located in a second position when the media stack tray has a loaded status. The probe is mounted relative to the media stack tray so that when the media stack tray has a loaded status the media is normally located between the probe and the dispensing device. The mechanism further includes a detector associated with the probe, the detector for detecting the position of the probe.

These and other objects of the invention will no doubt become obvious to those of ordinary skill in the art having read the following detailed description of the embodiment illustrated herein.

DESCRIPTION OF THE DRAWINGS

The present invention will now be described in relation to various embodiments illustrated in the accompanying drawings. However, it must be appreciated that the following description is not to limit the generality of the above description.

In the drawings.

DETAILED DESCRIPTION OF AN EMBODIMENT

Figure 1:
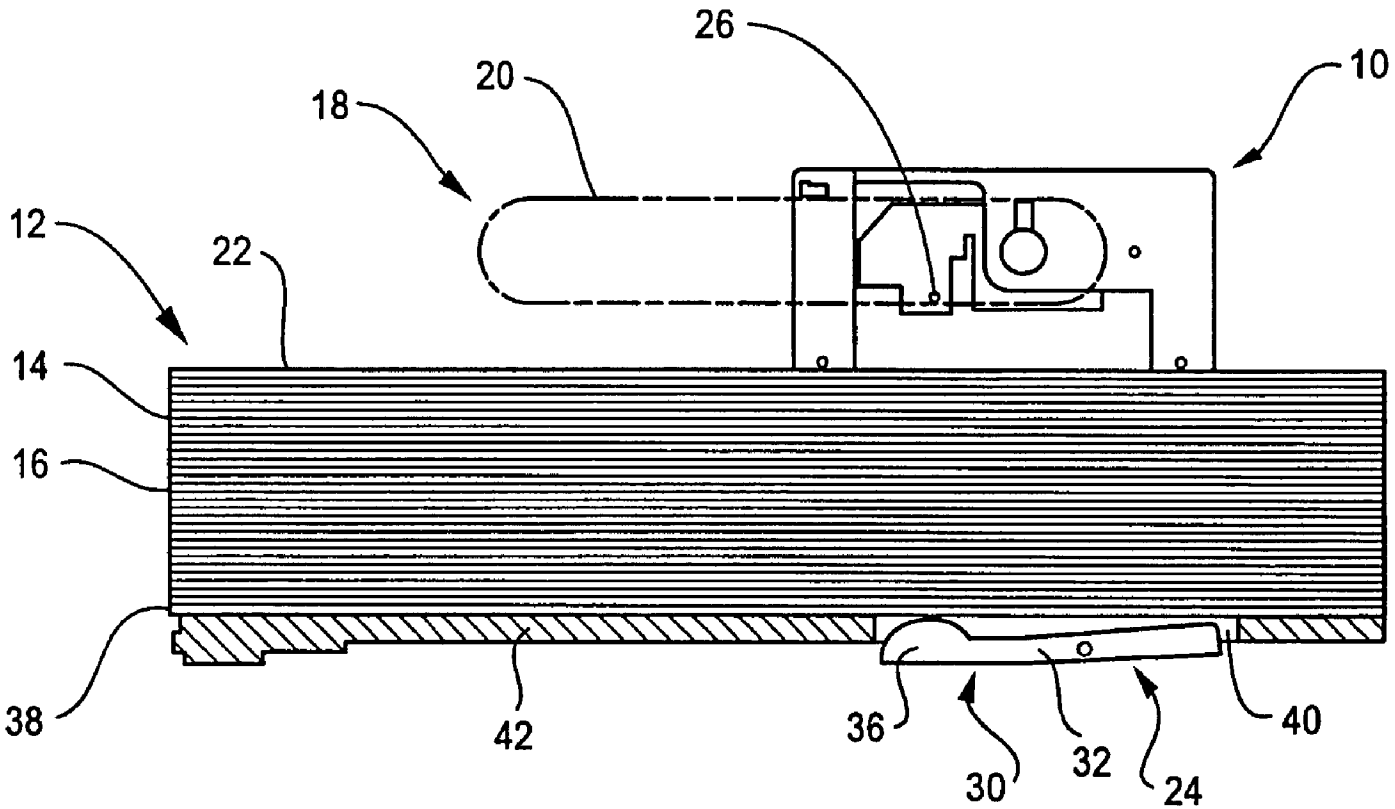
FIG. 1 is a side sectional view of a mechanism according to an embodiment of the invention showing the arrangement of the mechanism when the media stack tray has a loaded status.
Figure 2:
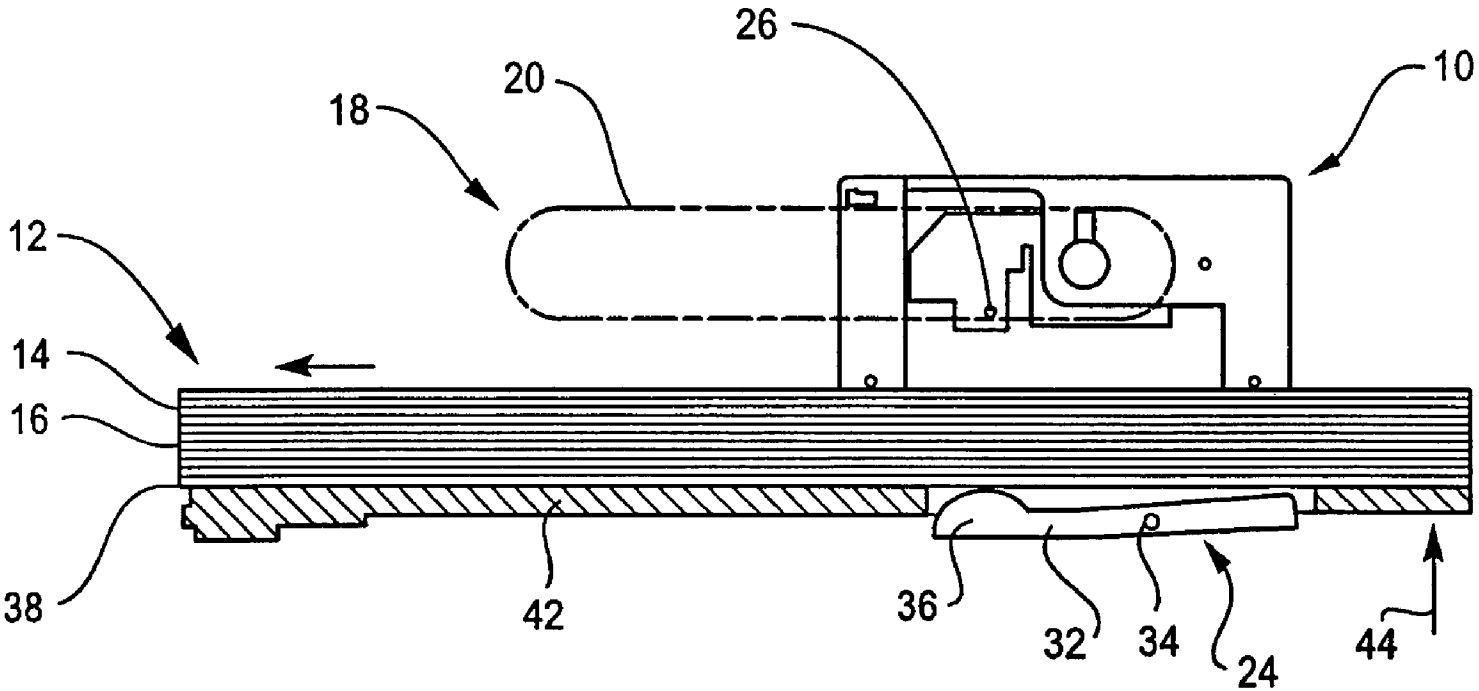
FIG. 2 is a side view of a sectional view of the mechanism according to the embodiment shown in FIG. 1 showing the arrangement of the mechanism during a dispensing cycle.
Figure 3:
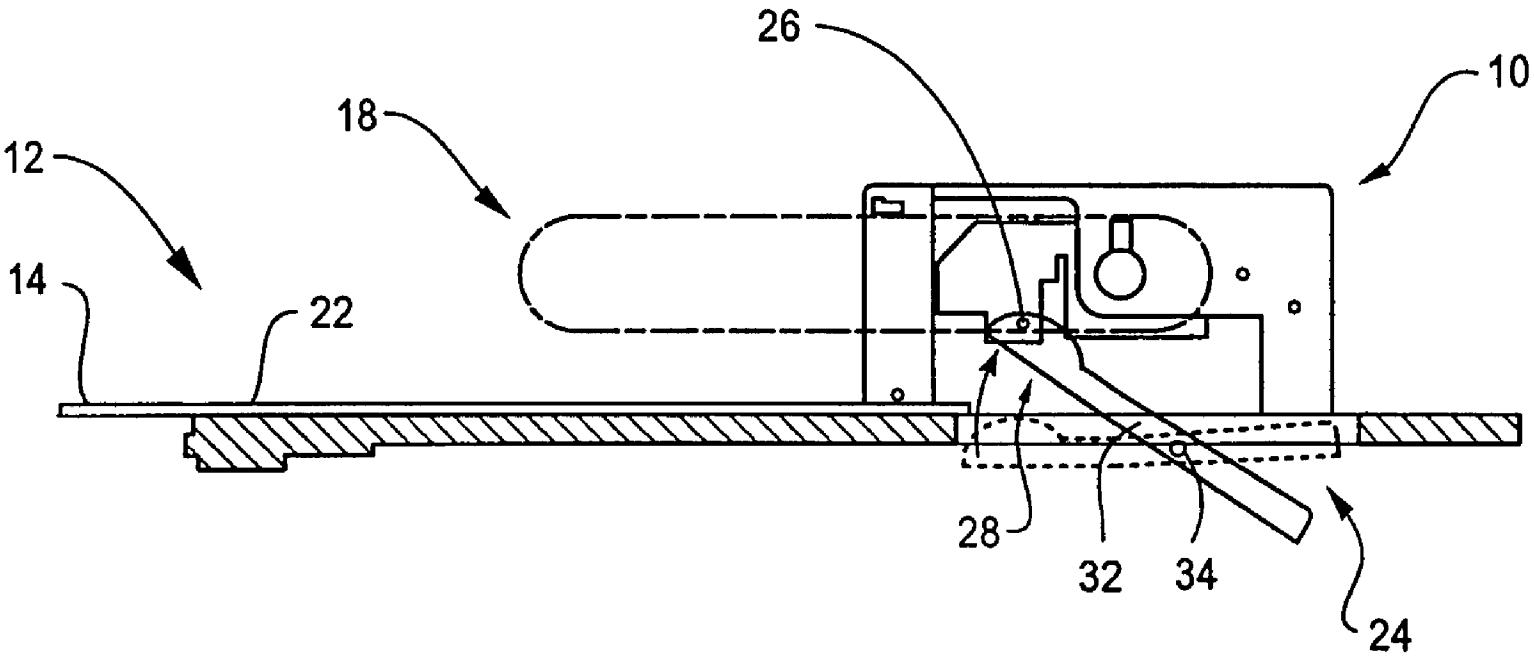
FIG. 3 is a side sectional view of a mechanism according to the embodiment shown in FIG. 1 showing the arrangement of the mechanism when the media stack tray has an empty status.

FIGS. 1, 2 and 3 illustrate a mechanism 10 for sensing the status of a media stack tray 12. The media stack tray 12 dispenses media 14 (refer to FIG. 2 and FIG. 3) from a media stack 16 to a printing device (such as a printer, a copier, a facsimile machine or the like). To aid in the description of an embodiment of the invention the media 14 will be referred to as a "sheet(s)", such as a sheet of paper. However, it will be appreciated that the media 14 may include a wide range of media from plain paper to special media such as cardboard, print film or the like.

As is shown, the media stack tray 12 is associated with a dispensing device 18 (shown here in dashed lines) which dispenses sheets from the media stack tray 12 during a dispensing cycle. In the embodiment illustrated, the dispensing device 18 is a pick arm 20 which is able to select the topmost sheet 22 of the media stack 16 and dispense the selected sheet from the media stack tray 12 during a dispensing cycle.

As is shown in FIGS. 1 and 3, the mechanism 10 includes a probe 24 and a detector 26 which is associated with the probe 24. The probe 24 shown here has two positions such that the probe 24 is located in a first position 28 (ref. FIG. 3) when the media stack tray 12 has an empty status, and is located in a second position 30 (refer FIG. 1) when the media stack tray 12 has a loaded status.

In an embodiment, the detector 26 is arranged relative to the probe 24 so as to detect the position of the probe 24 in the first position 28. However, it is envisaged that other arrangements will be possible in which the detector 26 may be arranged so as to detect the probe 24 in the second position 30, or both the second position 30 and the first position 28. Of course, in the case where the probe 24 has two positions, although the detector 26 may be arranged so as to detect the position of the probe 24 in the first position 28, it will be appreciated that when the detector 26 does not detect that the probe 24 is in the first position 28, then the probe 24 must be in the second position 30.

The probe 24 shown in FIGS. 1 to 3 includes a shaft 32 which is pivotably mounted to the media stack tray 12 using a pivot 34 (ref. FIG. 3). The illustrated probe 24 also includes a media contacting part 36 which is shown here as a convex surface arranged towards an end of the shaft 32.

As is illustrated in FIGS. 1 and 2, the probe 24 is arranged relative to the media stack tray 12 so that when the media stack tray 12 has a loaded status the media stack 16 is normally located between the probe 24 and the dispensing device 18. As will be described in more detail later, this arrangement results in the lowermost sheet 38 of the media stack 16 bearing against the media contacting part 36 of the probe 24 so as to locate the probe 24 in the second position 30. Accordingly, when there are plural sheets on the media stack tray 12, the media contacting part 36 of the probe 24 does not contact the sheet (generally the topmost sheet) which is being dispensed by the dispensing device 18. Indeed, in the illustrated embodiment, when the media stack tray 12 has a loaded status (and thus the probe 24 is located in the second position 30) the probe 24 is flush with the top surface of the media stack tray 12.

As is shown in FIG. 3, the illustrated arrangement of the pivotable mounting of the shaft 32 allows the probe 24 to freely rotate from the first position 28 to the second position 30 once the lowermost sheet 38 no longer bears against the media contacting part 36 of the probe 24. In the illustrated embodiment, the shaft 32 is mounted to the media stack tray 12 so that the probe 24 is situated in a slot 40 in the media stack tray 12 so as to allow the probe 24 to freely rotate therein.

FIG. 1 and FIG. 2 show the mechanism 10 with a loaded media stack tray 12. More specifically, in FIG. 1 there is shown a media stack tray 12 having a full media stack 16, whereas in FIG. 2 there is shown a media stack tray 12 having a media stack 16 from which one or more sheets have been dispensed. Nevertheless, in both FIG. 1 and FIG. 2 the media stack tray 12 has a loaded status. Thus, throughout this specification reference to the term "loaded" is to be understood to be reference to the media stack tray as containing at least one sheet.

As described previously, when the media stack tray 12 has a loaded status the media stack 16, via the lowermost sheer 38, bears against the media contacting part 36 of the probe 24 so as to locate the probe 24 in the second position 30.

In the illustrated embodiment, the media stack tray 12 is a biased platform 42 which moves upwardly 44 in response to the topmost sheet 22 of the media stack 16 being dispensed from the media stack tray 12. As a result of the movement of the platform 42, as the sheets are dispensed from the platform 42 a substantial constant positional relationship is maintained between the topmost sheet 22 of the media stack 16 and the pick arm 20. Moreover, after the lowermost sheet 38 has been dispensed from the media stack tray 12, the platform 12 is located at a predetermined position relative to the pick arm 20, and thus the detector 26.

As described briefly above, in the illustrated embodiment the probe 24 is pivotably mounted to the biased media platform 42. This is a particularly advantageous arrangement since after the lowermost sheet 38 of the media stack 16 has been dispensed from the media stack tray 12 the platform 42 is located in a predetermined position with respect to the dispensing device 18. Consequently, the position of the probe 24 relative to the detector 26 will also be predetermined. As a result, the probe 24 is able to be preconfigured so as to render the operation of the mechanism 10 independent of the height of the media stack 16. Accordingly, in this embodiment of the invention the mechanism 10 is able to accommodate a range of second media stack heights without requiring the geometry (for example, the length) of the probe 24 to be adjusted.

The probe 24 is gravitationally biased such that when the media stack tray 12 has an empty status the probe 24 rotates to the first position 28 (refer to FIG. 3). Thus, the probe 24 only rotates from the second position 30 to the first position 28 after the last sheet (in the present case, the lowermost sheet 38) no longer bears against the media contacting part 36 of the probe. On the other hand, when a sheet(s) is present in the media stack tray 12, the lowermost sheet 38 bears against media contacting part 36 so as to prevent the probe 24 from rotating to the first position 28. Thus, when a sheet(s) is located in the media stack tray the shaft is not located the first position 28, rather, it is located in second position 30 (refer to FIGS. 1 and 3).

In the illustrated embodiment, movement of the probe 24 from the second position 30 to the first position 28 occurs after the trailing edge of the lowermost sheet 38 moves so as to no longer bear against the media contacting part 36 of the probe 24. In this respect, in the illustrated embodiment once the trailing edge of the lowermost sheet 38 has so moved, the biasing of probe 24 caused the probe 24 to move in a clockwise direction to the first position 28.

According to the embodiment illustrated, when the media stack tray 12 is empty, the probe 24 does not need to be manipulated by a user for the purposes of reloading the media stack tray 12. Thus, the illustrated probe 24 does not need additional mechanisms for deactivating the probe to allow the media stack tray 12 to be removed from the printing device.

Having described the probe 24, the description will now turn to the detector 26. In an embodiment, the detector 26 is an opto-sensor, including, for example, a light emitting device (not shown) and a photodetector (not shown), which are arranged so that when the probe 24 is located in the first position 28 a portion of the probe 24 is located between the light emitting device and the photodetector to thereby interrupt a path therebetween. Thus, the location of the probe 24 in the first position 28 is sensed by detector 26 which then causes a signal to be generated which is indicative of the media stack tray 16 having an empty status.

In an embodiment of the invention, the detector 26 is connected to a monitoring circuit (not shown) which generates an alarm signal in response to the interruption of the path. The signal may be used to activate a response on a display, or audible device to thereby alert a user to the empty status of the media stack tray 12.

In FIGS. 1 to 3, the detector 26 is shown mounted to the pick arm 20. It is not essential that the detector 26 be mounted to the pick arm 20. Indeed, any suitable mounting may be used provided that the detector 26 is able to detect the probe 24 being located in the first position 28.

Finally, it will be understood that there may be other variations and modifications to the configurations described herein that are also within the scope of the present invention.

What is claimed is:

1. A mechanism for sensing the status of a media stack tray which dispenses media to a printing device, the media stack tray being associated with a dispensing device which dispenses media from the media stack tray, the mechanism comprising:

a probe having at least two positions such that the probe is located in a first position when the media stack tray has an empty status and is located in a second position when the media stack tray has a loaded status, the probe being mounted relative to the media stack tray so that when the media stack tray has a loaded status the media is normally located between the probe and the dispensing device; and a detector associated with the probe, the detector for detecting the position of the probe, wherein the probe and the detector are located on opposite sides of the media when the media stack tray has a loaded status.

2. The mechanism of claim 1, wherein the probe comprises:

a shaft which is pivotally mounted to the media stack tray, the shaft being biased so as to locate the probe in the first position when the media stack tray has an empty status; and a media contacting part extending from the shaft, said media contacting part bearing against the media stack when the media stack tray has a loaded status so as to locate the probe in the second position.

3. The mechanism of claim 2 wherein the shaft is gravitationally biased.

4. The mechanism of claim 3 wherein the detector and the dispensing device are arranged on the seine side of the media stack.

5. The mechanism of claim 2 wherein the probe is mounted on a stack support platform of the media stack tray, the stack support platform being biased so as to be movable relative to the dispensing device so as to maintain a substantially constant positional relationship between the top of to media stuck and the dispensing device.

6. A media stack tray for a printer, the media stack tray for dispensing media from a media stack, the media stack tray being associated with a dispensing device which dispenses media from the media stack tray, the media stack tray comprising:

a mechanism for sensing the status of the media stack tray, the mechanism including:

a media contacting probe having plural positions such that the media contacting probe is located in a first position when the media stack fray has an empty status and is located in a second position when the media stack tray has a loaded status; and a detector associated with the media contacting probe, the detector for detecting the position of the media contacting probe, wherein the probe and the detector are locate on opposite sides of the media when the media stack tray has a loaded status; and a platform for supporting the media stack wherein the media contacting probe is mounted to the platform so that when the media stuck tray has a loaded status the media is normally located between the probe and the dispensing device.

* * * * *

UNITED STATES PATENT AND TRADEMARK OFFICE

CERTIFICATE OF CORRECTION

PATENT NO. : 6,986,509 B2 
DATED : January 17, 2006
INVENTOR(S) : Seng San Koh, Wui Jein Koh and Wei Chun Lim It is certified that error appears in the above-identified patent and that said Letters Patent is hereby corrected as shown below:

Column 6,
Line 4, "seine" should read -- same --;
Line 27, "locate" should read -- located --;
Line 31, "stuck" should read -- stack --.

Signed and Sealed this

Fourth Day of April, 2006

JON W. DUDAS
*Director of the United States Patent and Trademark Office*